US011434113B2

(12) United States Patent
Hayashi

(10) Patent No.: US 11,434,113 B2
(45) Date of Patent: Sep. 6, 2022

(54) CRANE

(71) Applicant: TADANO LTD., Kagawa (JP)

(72) Inventor: Hiroyuki Hayashi, Kagawa (JP)

(73) Assignee: TADANO LTD., Kagawa (JP)

( * ) Notice: Subject to any disclaimer, the term of this patent is extended or adjusted under 35 U.S.C. 154(b) by 156 days.

(21) Appl. No.: 16/967,512

(22) PCT Filed: Mar. 8, 2019

(86) PCT No.: PCT/JP2019/009294
§ 371 (c)(1),
(2) Date: Aug. 5, 2020

(87) PCT Pub. No.: WO2019/172415
PCT Pub. Date: Sep. 12, 2019

(65) Prior Publication Data

US 2021/0221655 A1 Jul. 22, 2021

(30) Foreign Application Priority Data

Mar. 9, 2018 (JP) ..... JP2018-043256

(51) Int. Cl.

| | |
|---|---|
| ***B66C 23/00*** | (2006.01) |
| ***B66C 23/12*** | (2006.01) |
| ***B66C 1/48*** | (2006.01) |
| *B66C 13/46* | (2006.01) |

(52) U.S. Cl.
CPC ..... *B66C 23/12* (2013.01); *B66C 1/48* (2013.01); *B66C 13/46* (2013.01); *B66C 2700/03* (2013.01)

(58) Field of Classification Search
CPC ..... B66C 23/12; B66C 13/085; B66C 13/44; B66C 13/46; B66C 13/48
See application file for complete search history.

(56) References Cited

FOREIGN PATENT DOCUMENTS

| | | | |
|---|---|---|---|
| JP | 2001328796 | A | * 11/2001 |
| JP | 2002106510 | A | * 4/2002 |
| JP | 2003026393 | A | * 1/2003 |
| JP | 2003073075 | A | * 3/2003 |
| JP | 2003285992 | A | * 10/2003 |
| JP | 2017-030634 | A | 2/2017 |
| JP | 2017-122003 | A | 7/2017 |

OTHER PUBLICATIONS

May 21, 2019, International Search Report issued for related PCT Application No. PCT/JP2019/009294.
May 21, 2019, International Search Opinion issued for related PCT Application No. PCT/JP2019/009294.

* cited by examiner

*Primary Examiner* — Emmanuel M Marcelo
(74) *Attorney, Agent, or Firm* — Paratus Law Group, PLLC

(57) ABSTRACT

Provided is a crane (1) comprising: a boom (7) capable of being raised, lowered, and telescoped; a wire rope (8) being suspended from the boom (7); a winch (9) for winding and unwinding the wire rope (8); and a hook (10) being raised and lowered by the winding and unwinding of the wire rope (8). The crane further comprises a spooling operation instrument (24) for enabling commanding an operation state of the winch (9). When the hook (10) is raised to a height at which the hanging length d is a prescribed value by an operation of the spooling operation instrument (24), the boom (7) is raised and extended while the wire rope (8) is unwound such that the prescribed hanging length d is maintained, thereby sustaining the elevation operation of the hook (10).

18 Claims, 14 Drawing Sheets

CRANE

CROSS REFERENCE TO PRIOR APPLICATION

This application is a National Stage Patent Application of PCT International Patent Application No. PCT/JP2019/009294 (filed on Mar. 8, 2019) under 35 U.S.C. § 371, which claims priority to Japanese Patent Application No. 2018-043256 (filed on Mar. 9, 2018), which are all hereby incorporated by reference in their entirety.

TECHNICAL FIELD

The present invention relates to cranes. More specifically, the present invention relates to a crane which achieves improvement in manipulability and safety.

BACKGROUND ART

Conventionally, a crane, which is a typical work vehicle, has been known (see Patent Literature (hereinafter referred to as "PTL") 1). The crane is mainly composed of a traveling body and a swiveling body. The traveling body is provided with a plurality of wheels and is configured to travel freely. The swiveling body is provided with a boom, a wire rope, a winch, and a hook, and is configured to carry a load freely.

Note that, such a crane performs carriage operation for a load in a state in which the boom is luffed up and extended (see PTL 2). However, there has been a problem that manipulation of luffing up and extending the boom at the same time as unwinding the wire rope is complicated and difficult. Moreover, there has also been another problem that, when appropriate manipulation is not performed in the luffing-up operation and the extension operation of the boom, the hook or the load moves horizontally to collide with the side surface of a building or the like. In addition, these problems also exist in connection with manipulation of luffing down and retracting the boom at the same time as winding the wire rope. Hence, a crane which achieves improvement in manipulability and safety has been required.

CITATION LIST

Patent Literature

PTL 1
Japanese Patent Application Laid-Open No. 2017-122003
PTL 2
Japanese Patent Application Laid-Open No. 2017-30634

SUMMARY OF INVENTION

Technical Problem

A crane which achieves improvement in manipulability and safety is provided.

Solution to Problem

The crane of the present invention is a crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane including:

a winding manipulation tool that allows giving an instruction on an operating state of the winch, in which, it is preferable that, after the hook is raised by manipulation of the winding manipulation tool to a height at which a suspension length is a predetermined suspension length, the boom is luffed up and extended to continue raising operation of the hook while the wire rope is unwound such that the suspension length is kept.

In the crane of the present invention, the raising operation of the hook is performed vertically upward by adjusting luffing-up operation and extension operation of the boom.

In the crane of the present invention, a raising operation speed of the hook raised by luffing-up operation and extension operation of the boom is changeable by the manipulation of the winding manipulation tool.

The crane of the present invention is a crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane including:

a winding manipulation tool that allows giving an instruction on an operating state of the winch; and a switch that allows instructing that a suspension length of the hook be kept, in which, when the winding manipulation tool is manipulated in one direction while the switch is in an "ON" state, the boom is luffed up and extended to raise the hook while the wire rope is unwound such that the suspension length of the hook is kept, and, when the winding manipulation tool is manipulated in an other direction while the switch is in the "ON" state, the boom is luffed down and retracted to lower the hook while the wire rope is wound such that the suspension length of the hook is kept.

In the crane of the present invention, raising/lowering operation of the hook is performed vertically upward or vertically downward by adjusting luffing-up operation and extension operation of the boom or luffing-down operation and retraction operation of the boom.

In the crane of the present invention, a raising/lowering operation speed of the hook raised by luffing-up operation and extension operation of the boom or lowered by luffing-down operation and retraction operation of the boom is changeable by the manipulation of the winding manipulation tool.

The crane of the present invention is a crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane including:

a winding manipulation tool that allows giving an instruction on an operating state of the winch; and a switch that allows instructing that a lifting height of the hook be kept, in which, when the winding manipulation tool is manipulated in one direction while the switch is in an "ON" state, the boom is luffed up and extended to change a posture of the boom while the wire rope is unwound such that the lifting height of the hook is kept, and, when the winding manipulation tool is manipulated in an other direction while the switch is in the "ON" state, the boom is luffed down and retracted to change the posture of the boom while the wire rope is wound such that the lifting height of the hook is kept.

In the crane of the present invention, a position of the hook is maintained by adjusting luffing-up operation and extension operation of the boom or luffing-down operation and retraction operation of the boom.

In the crane of the present invention, a postural change speed of the boom in luffing-up operation and extension operation of the boom or in luffing-down operation and retraction operation of the boom is changeable by manipulation of the winding manipulation tool.

Advantageous Effects of Invention

According to the crane of the present invention, the crane includes the winding manipulation tool that allows giving an instruction on the operating state of the winch. After the hook is raised by manipulation of the winding manipulation tool to a height at which a suspension length is a predetermined suspension length, the boom is luffed up and extended to continue raising operation of the hook while the wire rope is unwound such that the suspension length is kept. According to such a crane, manipulation of luffing up and extending the boom while unwinding the wire rope at the same time is not required. Further, since no manipulative error can occur in connection with the manipulation of luffing up and extending the boom, it is possible to prevent the hook or a load from colliding with the side surface of a building or the like. Accordingly, it is possible to achieve improvement in manipulability and safety.

According to the crane of the present invention, the raising operation of the hook is performed vertically upward by adjusting the luffing-up operation and the extension operation of the boom. According to such a crane, since the hook or the load does not move horizontally, it is possible to achieve further improvement in safety.

According to the crane of the present invention, the raising operation speed of the hook raised by the luffing-up operation and the extension operation of the boom is changeable by the manipulation of the winding manipulation tool. According to such a crane, since the raising operation speed can be easily increased or decreased at the will of an operator, it is possible to achieve further improvement in manipulability and safety.

According to the crane of the present invention, the crane includes the winding manipulation tool that allows giving an instruction on the operating state of the winch, and the switch that allows instructing that the suspension length of the hook be kept. When the winding manipulation tool is manipulated in one direction while the switch is in the "ON" state, the boom is luffed up and extended to raise the hook while the wire rope is unwound such that the suspension length of the hook is kept, and when the winding manipulation tool is manipulated in an other direction while the switch is in the "ON" state, the boom is luffed down and retracted to lower the hook while the wire rope is wound such that the suspension length of the hook is kept. According to such a crane, manipulation of luffing up and extending the boom while unwinding the wire rope at the same time is not required. Further, since no manipulative error can occur in connection with the manipulation of luffing up and extending the boom, it is possible to prevent the hook or a load from colliding with the side surface of a building or the like. Likewise, according to such a crane, manipulation of luffing down and retracting the boom while winding the wire rope at the same time is not required. Since no manipulative error can occur in connection with the manipulation of luffing down and retracting the boom, it is possible to prevent the hook or the load from colliding with the side surface of a building or the like. Accordingly, it is possible to achieve improvement in manipulability and safety.

According to the crane of the present invention, the raising/lowering operation of the hook is performed vertically upward or vertically downward by adjusting luffing-up operation and extension operation of the boom or luffing-down operation and retraction operation of the boom. According to such a crane, since the hook or the load does not move horizontally, it is possible to achieve further improvement in safety.

According to the crane of the present invention, the raising/lowering operation speed of the hook raised by the luffing-up operation and the extension operation of the boom or lowered by the luffing-down operation and the retraction operation of the boom is changeable by the manipulation of the winding manipulation tool. According to such a crane, since the raising/lowering operation speed can be easily increased or decreased at the will of an operator, it is possible to achieve further improvement in manipulability and safety.

According to the crane of the present invention, the crane includes the winding manipulation tool that allows giving an instruction on the operating state of the winch, and the switch that allows instructing that the lifting height of the hook be kept. When the winding manipulation tool is manipulated in one direction while the switch is in the "ON" state, the boom is luffed up and extended to change a posture of the boom while the wire rope is unwound such that the lifting height of the hook is kept, and when the winding manipulation tool is manipulated in an other direction while the switch is in the "ON" state, the boom is luffed down and retracted to change the posture of the boom while the wire rope is wound such that the lifting height of the hook is kept. According to such a crane, manipulation of luffing up and extending the boom while unwinding the wire rope at the same time is not required. Further, since no manipulative error can occur in connection with the manipulation of luffing up and extending the boom, it is possible to prevent the hook or a load from colliding with the side surface of a building or the like. Likewise, according to such a crane, manipulation of luffing down and retracting the boom while winding the wire rope at the same time is not required. Further, since no manipulative error can occur in connection with the manipulation of luffing down and retracting the boom, it is possible to prevent the hook or the load from colliding with the side surface of a building or the like. Accordingly, it is possible to achieve improvement in manipulability and safety.

According to the crane of the present invention, the position of the hook is maintained by adjusting luffing-up operation and extension operation of the boom or luffing-down operation and retraction operation of the boom. According to such a crane, since the hook or the load does not move in the upper-lower direction or in the horizontal direction, it is possible to achieve further improvement in safety.

According to the crane of the present invention, the postural change speed of the boom in the luffing-up operation and the extension operation of the boom or in the luffing-down operation and the retraction operation of the boom is changeable by manipulation of the winding manipulation tool. According to such a crane, since the postural change speed can be easily increased or decreased at the will of an operator, it is possible to achieve further improvement in manipulability and safety.

DESCRIPTION OF EMBODIMENT

Figure 1:
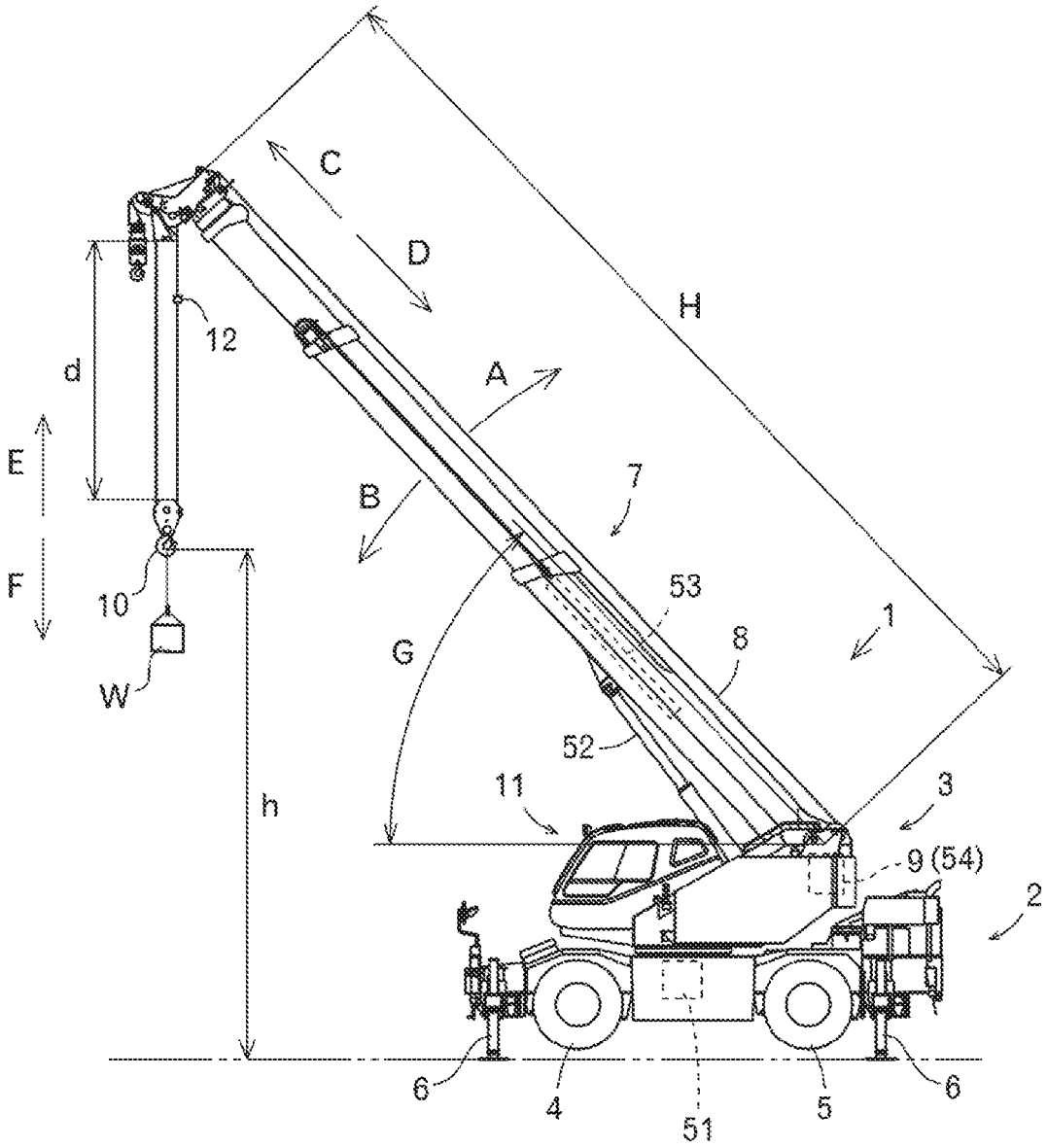
FIG. 1 illustrates a crane.

The technical idea disclosed in the present specification is applicable not only to crane 1 described below but also to other cranes.

To begin with, the outline of crane 1 will be described with reference to FIGS. 1 and 2.

Crane 1 is mainly composed of traveling body 2 and swiveling body 3.

Traveling body 2 includes a pair of left and right front tires 4 and a pair of left and right rear tires 5. In addition, traveling body 2 is provided with outriggers 6 that are brought into contact with the ground for stabilization when carriage work for load W is performed. Further, traveling body 2 includes an actuator for driving these parts, an engine, a transmission, and the like. Note that, swiveling body 3 supported on traveling body 2 is swivelable by an actuator in traveling body 2.

Swiveling body 3 is provided with boom 7 protruding forward from the rear of the swiveling body. Accordingly, boom 7 is swivelable by an actuator. Further, boom 7 is capable of being luffed up and down by an actuator (see arrows A and B). Further, boom 7 is capable of being extended and retracted by an actuator (see arrows C and D). In addition, wire rope 8 is stretched in boom 7. Winch 9 around which wire rope 8 is wound is disposed on the base end side of boom 7, and hook 10 is hung by wire rope 8 on the leading end side of boom 7. Winch 9 is integrated with an actuator to allow winding and unwinding of wire rope 8. Thus, hook 10 is capable of being raised and lowered by the actuator (see arrows E and F). Note that, swiveling body 3 is provided with cabin 11 laterally with respect to boom 7. A handle and/or a gearshift required for traveling manipulation, and, swivel manipulation tool 21, luffing manipulation tool 22, extension/retraction manipulation tool 23, and winding manipulation tool 24 required for carriage manipulation are disposed inside cabin 11. Further, switching button 25 is disposed.

Figure 3:
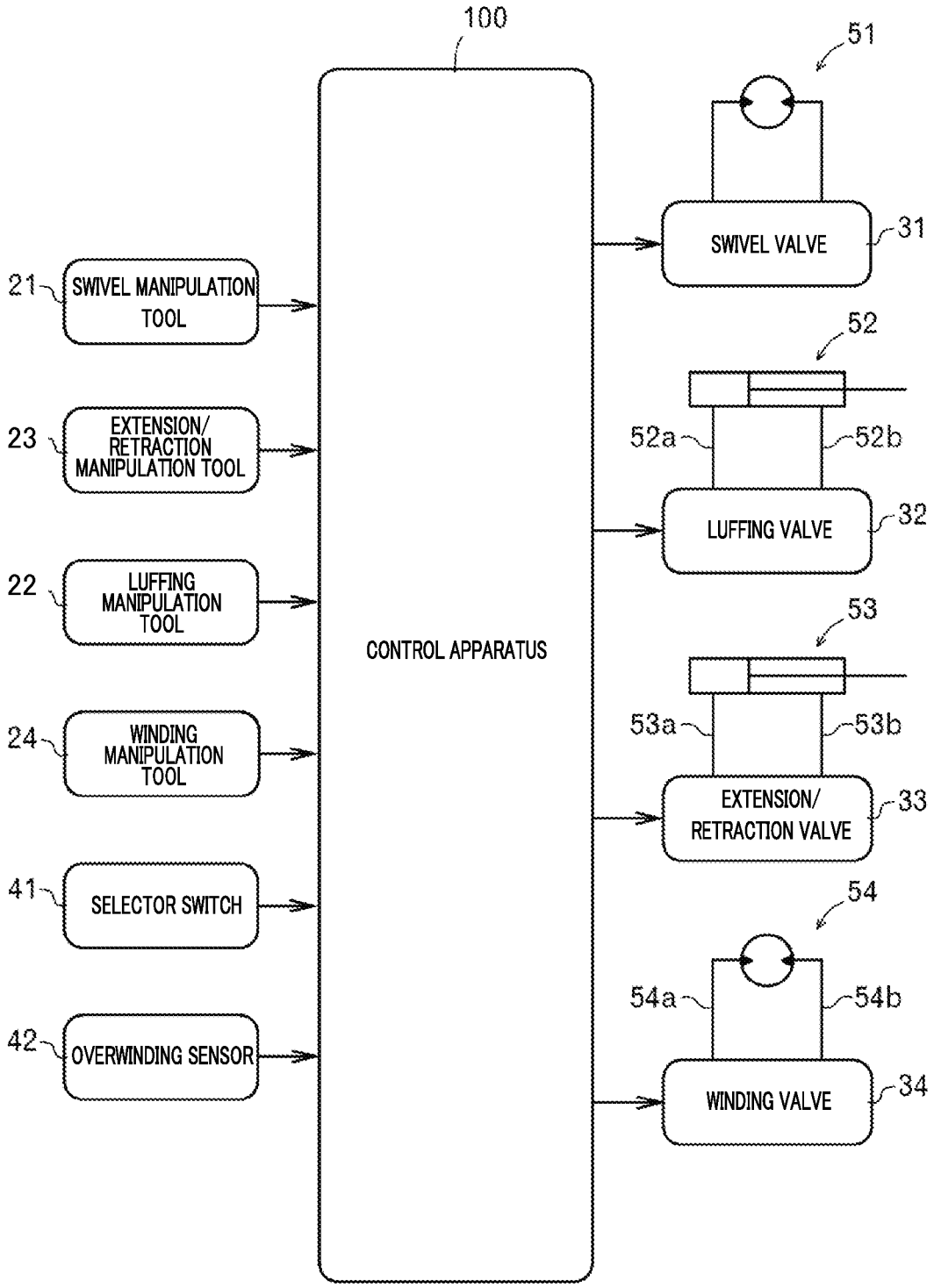
FIG. 3 illustrates a configuration of a control system.
Figure 4:
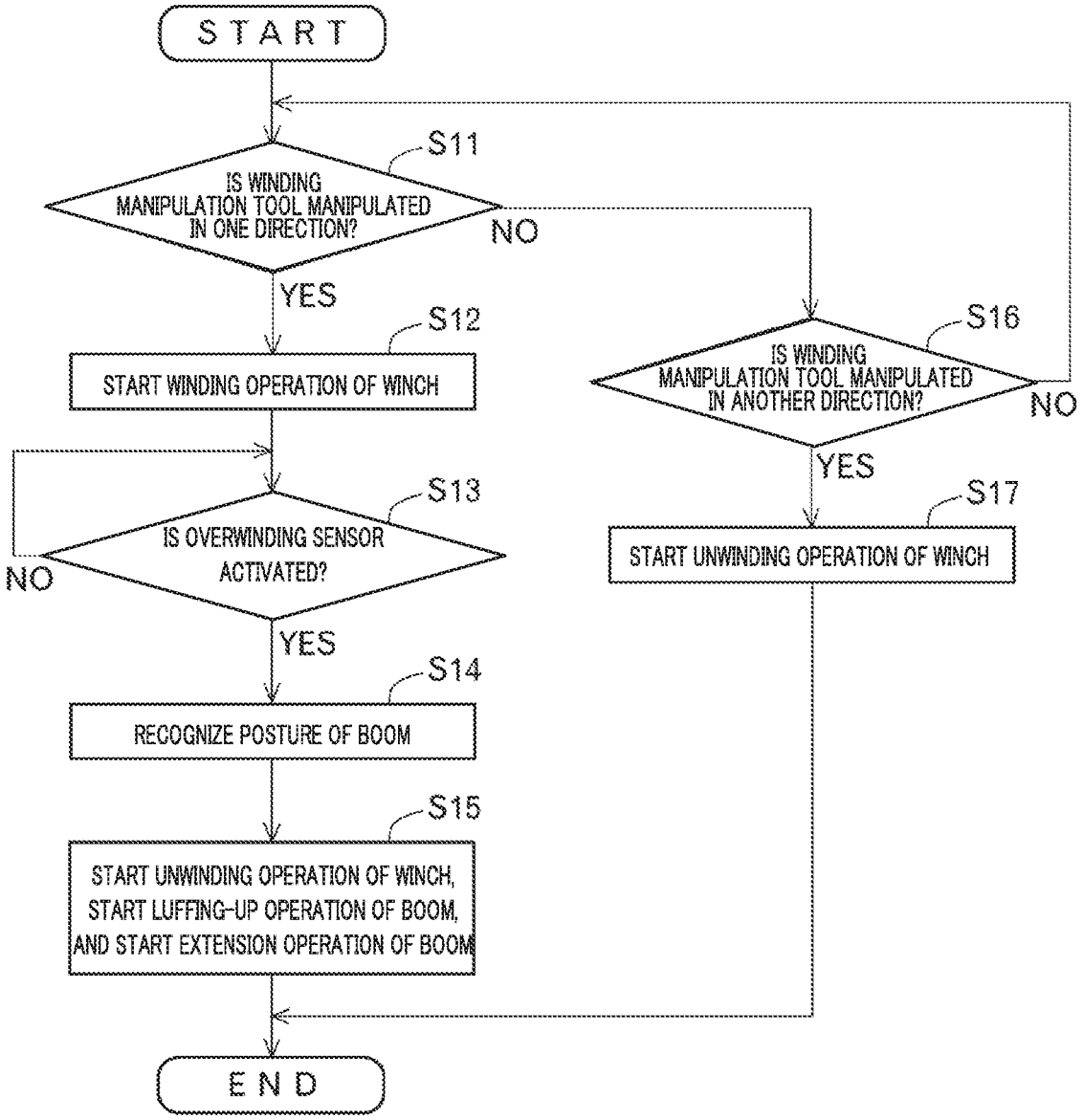
FIG. 4 illustrates a control mode for manipulation of a winding manipulation tool.
Figure 5:
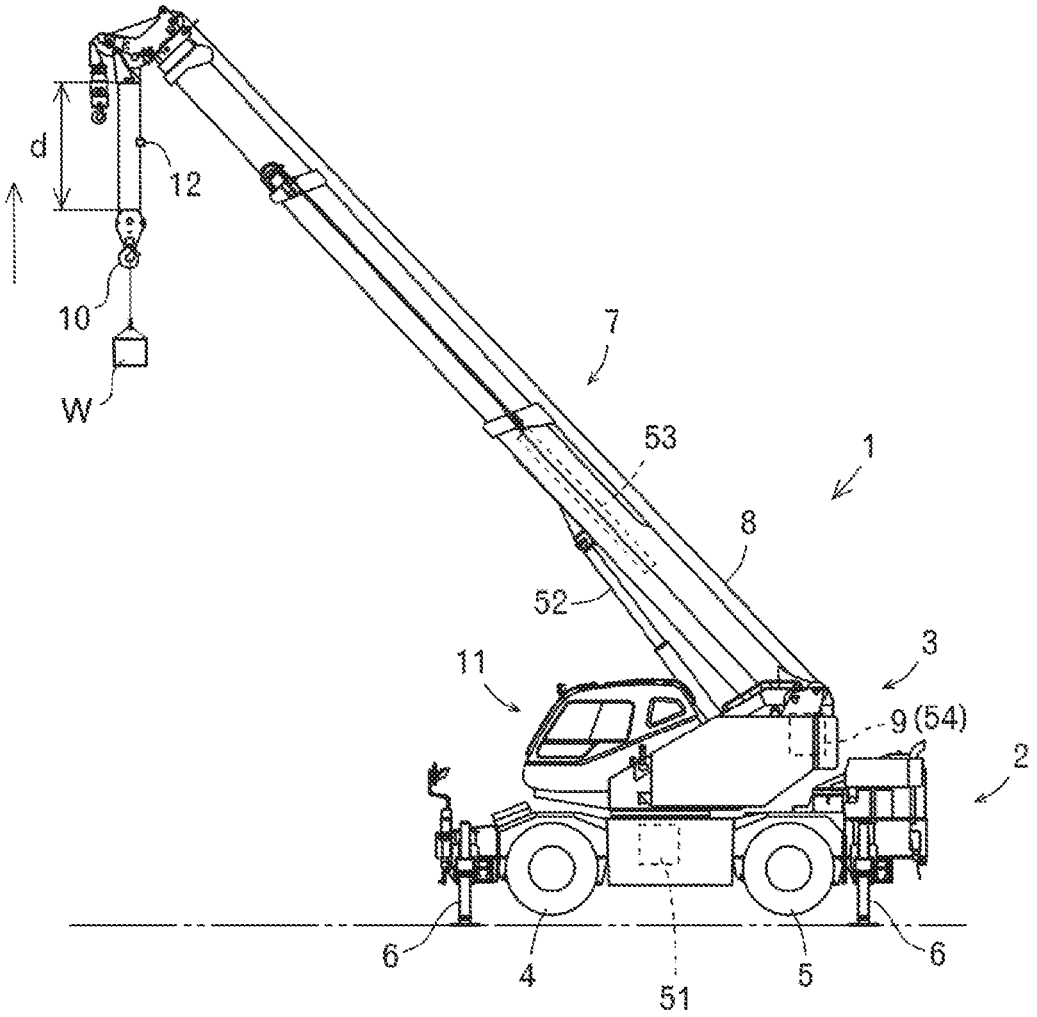
FIG. 5 illustrates a situation in which a load is being hoisted by winding operation of a winch.
Figure 6:
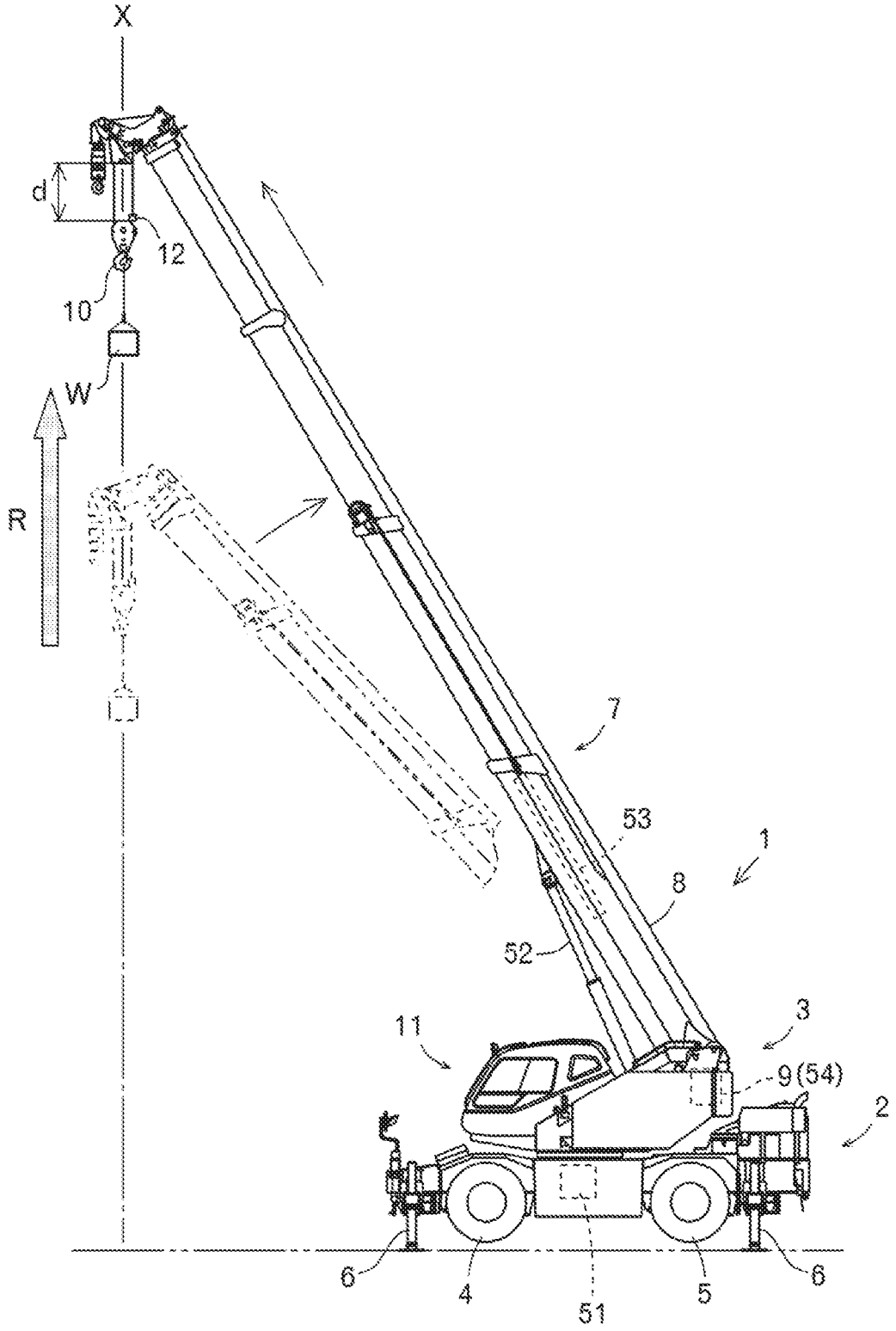
FIG. 6 illustrates a situation in which the load is being hoisted by luffing-up operation and extension operation of a boom.
Figure 7:
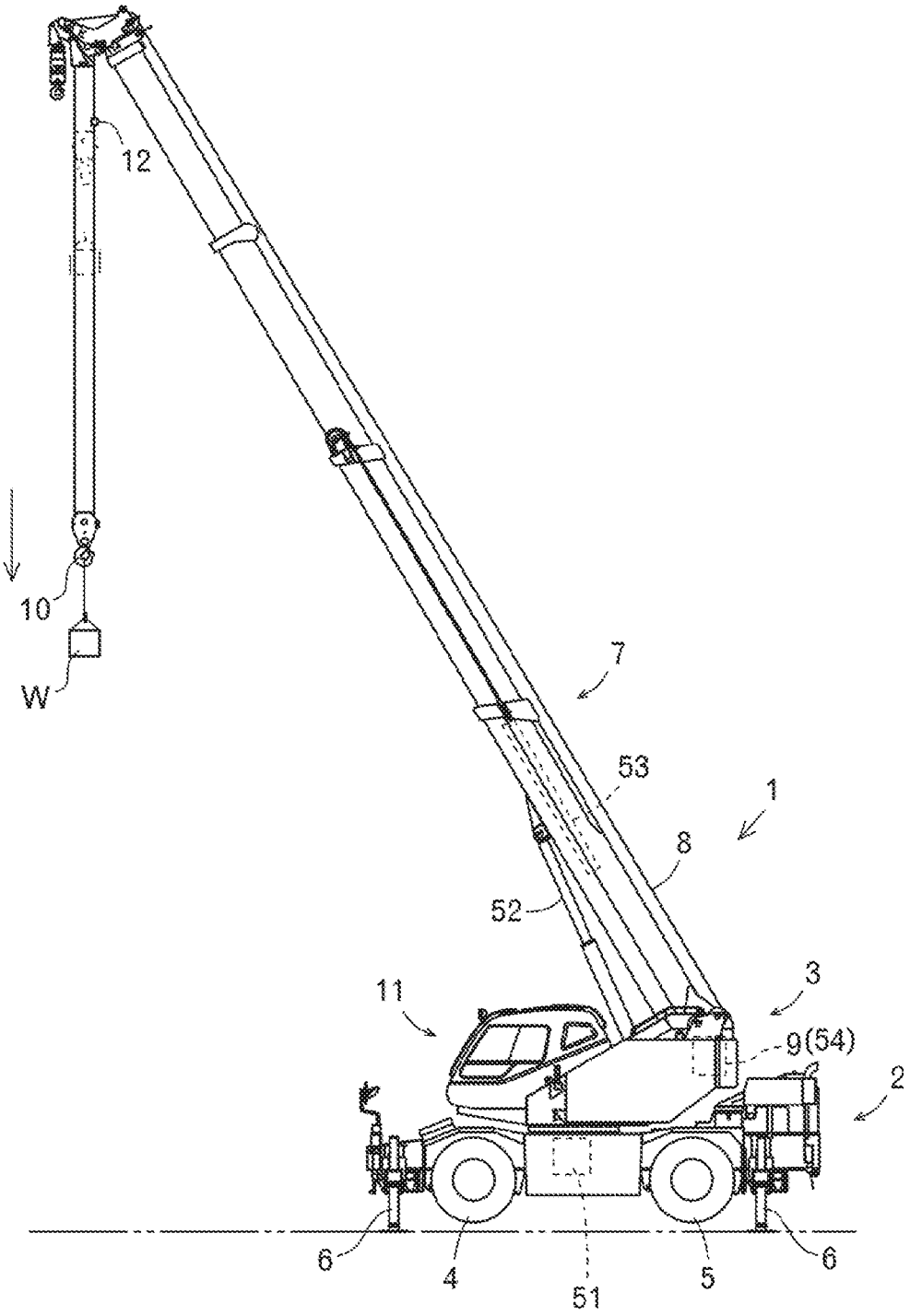
FIG. 7 illustrates a situation in which the load suspended is lowered by unwinding operation of the winch.

Next, the outline of a control system will be described with reference to FIG. 3.

The control system is configured mainly by control apparatus 100. Various manipulation tools 21 to 24 are connected to control apparatus 100. Further, various valves 31 to 34 are connected to control apparatus 100.

As described above, boom 7 is swivelable by the actuator. In the present specification, such an actuator is defined as swivel motor 51. Swivel motor 51 is appropriately operated by swivel valve 31, which is an electromagnetic proportional switching valve. That is, swivel motor 51 is appropriately operated by swivel valve 31 switching the flow direction of hydraulic oil and/or adjusting the flow rate of the hydraulic oil. Note that, the swivel angle and/or the swivel speed of boom 7 are detected by a sensor (not illustrated). Control apparatus 100 can thus recognize the swivel angle and/or the swivel speed of boom 7.

Further, boom 7 is capable of being luffed up and down by the actuator as described above (see arrows A and B in FIG. 1). In the present specification, such an actuator is defined as luffing cylinder 52. Luffing cylinder 52 is appropriately operated by luffing valve 32, which is an electromagnetic proportional switching valve. That is, luffing cylinder 52 is appropriately operated by luffing valve 32 switching the flow direction of hydraulic oil and/or adjusting the flow rate of the hydraulic oil. Note that, luffing angle G (see FIG. 1) and/or the luffing speed of boom 7 are detected by a sensor (not illustrated). Control apparatus 100 can thus recognize luffing angle G and/or the luffing speed of boom 7.

Further, boom 7 is capable of being extended and retracted by the actuator as described above (see arrows C and D in FIG. 1). In the present specification, such an actuator is defined as extension/retraction cylinder 53. Extension/retraction cylinder 53 is appropriately operated by extension/retraction valve 33, which is an electromagnetic proportional switching valve. That is, extension/retraction cylinder 53 is appropriately operated by extension/retraction valve 33 switching the flow direction of hydraulic oil and/or adjusting the flow rate of the hydraulic oil. Note that, extension/retraction length H (see FIG. 1) and/or the extension/retraction speed of boom 7 are detected by a sensor (not illustrated). Control apparatus 100 can thus recognize extension/retraction length H and/or the extension/retraction speed of boom 7.

Further, hook 10 is capable of being raised and lowered by the actuator as described above (see arrows E and F in FIG. 1). In the present specification, such an actuator is defined as winding motor 54. Winding motor 54 is appropriately operated by winding valve 34, which is an electromagnetic proportional switching valve. That is, winding motor 54 is appropriately operated by winding valve 34 switching the flow direction of hydraulic oil and/or adjusting the flow rate of the hydraulic oil. Note that, suspension length d (see FIG. 1) and/or the raising/lowering speed of hook 10 are detected by a sensor (not illustrated). Control apparatus 100 can thus recognize suspension length d and/or the raising/lowering speed of hook 10.

With such a configuration, control apparatus 100 can control the actuators (51, 52, 53, and 54) via respective valves 31 to 34. However, it is expected that the actuators (51, 52, 53, and 54) are substituted by electric actuators in the near future. In this case, control apparatus 100 can directly control the electric actuators without respective valves 31 to 34.

In addition, selector switch 41 and overwinding sensor 42 are connected to control apparatus 100.

Selector switch 41 is attached to a bolt portion of switching button 25 described above. An operator can instruct control apparatus 100 to switch the control mode for manipulation of winding manipulation tool 24 by pressing switching button 25.

Overwinding sensor 42 is attached to weight 12 (see FIG. 1) suspended at the leading end portion of boom 7. Overwinding sensor 42 is designed to be activated when hook 10 is raised to elevate weight 12. Control apparatus 100 thus can automatically recognize that hook 10 has risen to a height at which the suspension length is predetermined suspension length d (see FIG. 1). However, the control apparatus may compute the distance from the leading end portion of boom 7 to hook 10 based on the length of wire rope 8 wound around winch 9, so as to automatically recognize that hook 10 has risen to the height at which the suspension length is predetermined suspension length d.

Next, a control mode for manipulation of winding manipulation tool 24 will be described with reference to FIGS. 4 to 7. Here, the description will be given of a case where switching button 25 is not pressed.

At step S11, control apparatus 100 determines whether or not winding manipulation tool 24 is manipulated in one direction (direction in which hook 10 is raised). When it is determined that winding manipulation tool 24 has been manipulated in the one direction, the control proceeds to step S12, and when it is determined that winding manipulation tool 24 has not been manipulated in the one direction, the control proceeds to step S16.

At step S12, control apparatus 100 starts winding operation of winch 9. Specifically, control apparatus 100 controls winding valve 34 to supply hydraulic oil to winding motor 54 through pipe 54*a*. Then, winding motor 54 rotates in one direction at an appropriate speed. That is, winch 9 rotates forward at an appropriate speed. Thus, winch 9 winds wire rope 8 to raise hook 10, so that load W is hoisted (see FIG. 5). Thereafter, the control proceeds to step S13.

At step S13, control apparatus 100 determines whether or not overwinding sensor 42 is activated. In other words, it is determined whether or not hook 10 has risen to a height at which the suspension length is predetermined suspension length d. When it is determined that hook 10 has risen to the height at which the suspension length is predetermined suspension length d, the control proceeds to step S14, and when it is determined that hook 10 has not risen to the height at which the suspension length is predetermined suspension length d, the winding operation of winch 9 is continued.

Figure 2:
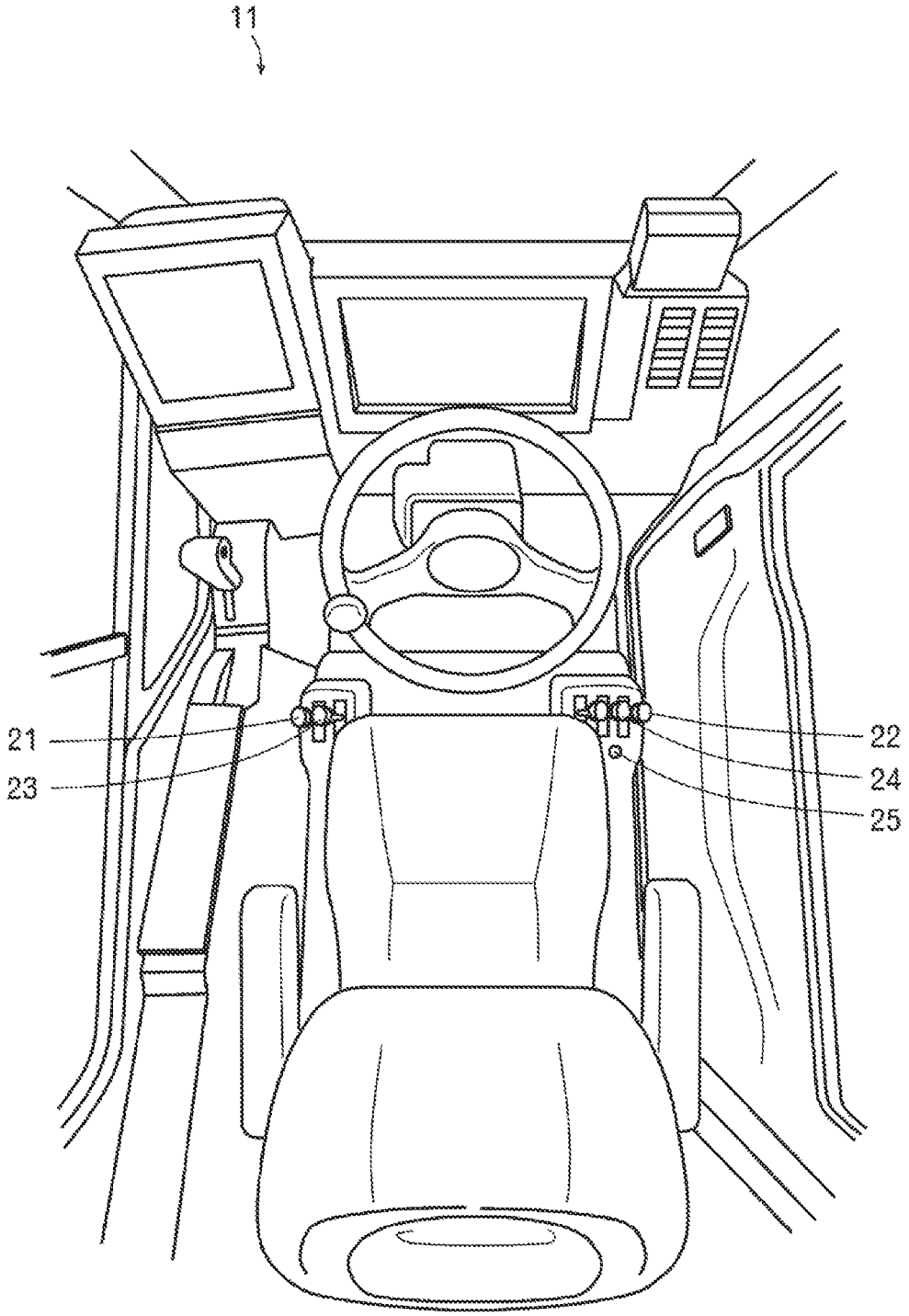
FIG. 2 illustrates the inside of a cabin.

At step S14, control apparatus 100 recognizes the posture of boom 7 (boom angle G and boom length H; see FIG. 1). This is because the control amount for each control target changes depending on the posture of boom 7. This is because the extension amount of boom 7 is small with respect to the angular change caused by the luffing-up operation in a posture in which boom 7 is relatively luffed down and boom angle G is small, but the extension amount of boom 7 is large with respect to the angular change caused by the luffing-up operation in a posture in which boom 7 is relatively luffed up and boom angle G is large, for example. Note that, the unwinding amount of wire rope 8 unwound by winch 9 is associated with the extension amount of boom 7. Thereafter, the control proceeds to step S15.

At step S15, control apparatus 100 starts the unwinding operation of winch 9 and also starts the luffing-up operation and the extension operation of boom 7. Specifically, control apparatus 100 controls winding valve 34 to supply hydraulic oil to winding motor 54 through pipe 54*b*. Then, winding motor 54 rotates in an other direction at an appropriate speed. That is, winch 9 rotates reversely at an appropriate speed.

Control apparatus 100 starts luffing-up operation of boom 7 at the same time. Specifically, control apparatus 100 controls luffing valve 32 to supply hydraulic fluid to luffing cylinder 52 through pipe 52*a*. Then, luffing cylinder 52 extends at an appropriate speed. That is, boom 7 is luffed up at an appropriate speed.

Further, control apparatus 100 starts extension operation of boom 7 at the same time. Specifically, control apparatus 100 controls extension/retraction valve 33 to supply hydraulic fluid to extension/retraction cylinder 53 through pipe 53*a*. Then, extension/retraction cylinder 53 extends at an appropriate speed. That is, boom 7 extends at an appropriate speed. Thus, it is possible to continue the raising operation of hook 10 raised by the luffing-up operation and the extension operation of boom 7 (see arrow R in FIG. 6) while keeping suspension length d of hook 10. Note that, hook 10 rises along imaginary line X that is parallel to the direction in which gravity acts. This is achieved by adjusting the speed at which boom 7 is luffed up and the speed at which boom 7 extends. In addition, the speed at which boom 7 is luffed up and the speed at which boom 7 extends can be changed by manipulation of winding manipulation tool 24, with the association with each other being maintained. Thus, the raising operation speed of hook 10 is changeable by the manipulation of winding manipulation tool 24. Further, the raising operation speed of hook 10 immediately after the hook reaches the height at which the suspension length is predetermined suspension length d is continuous with respect to the raising operation speed of hook 10 immediately before the hook reaches the height at which the suspension length is predetermined suspension length d. This is to prevent hook 10 or load W from becoming unstable due to a gear-shifting shock (vibration due to a speed difference).

Meanwhile, at step S16, control apparatus 100 determines whether or not winding manipulation tool 24 is manipulated in the other direction (direction in which hook 10 is lowered). When it is determined that winding manipulation tool 24 has been manipulated in the other direction, the control proceeds to step S17, and when it is determined that winding manipulation tool 24 has not been manipulated also in the other direction, the control waits without proceeding.

At step S17, control apparatus 100 starts unwinding operation of winch 9. Specifically, control apparatus 100 controls winding valve 34 appropriately to supply hydraulic oil to winding motor 54 through pipe 54*b*. Then, winding motor 54 rotates in the other direction at an appropriate speed. That is, winch 9 rotates reversely at an appropriate speed. Thus, winch 9 unwinds wire rope 8 to lower hook 10, so that load W suspended is lowered (see FIG. 7).

As described above, crane 1 of the present invention includes winding manipulation tool 24 that allows giving an instruction on the operating state of winch 9. After hook 10 is raised by manipulation of winding manipulation tool 24 to a height at which the suspension length is predetermined suspension length d, boom 7 is luffed up and extended to continue the raising operation of hook 10 while wire rope 8 is unwound such that suspension length d is kept. According to such a crane 1, manipulation of luffing up and extending boom 7 while unwinding wire rope 8 at the same time is not required. Further, since no manipulative error can occur in connection with the manipulation of luffing up and extending boom 7, it is possible to prevent hook 10 or load W from colliding with the side surface of a building or the like. Accordingly, it is possible to achieve improvement in manipulability and safety.

Further, according to crane 1 of the present invention, the raising operation of hook 10 is performed vertically upward by adjusting the luffing-up operation and the extension operation of boom 7. According to such a crane 1, since hook 10 or load W does not move horizontally, it is possible to achieve further improvement in safety.

Further, according to crane 1 of the present invention, the raising operation speed of hook 10 raised by the luffing-up operation and the extension operation of boom 7 is changeable by the manipulation of winding manipulation tool 24. According to such a crane 1, since the raising operation speed can be easily increased or decreased at the will of an operator, it is possible to achieve further improvement in manipulability and safety.

Figure 8:
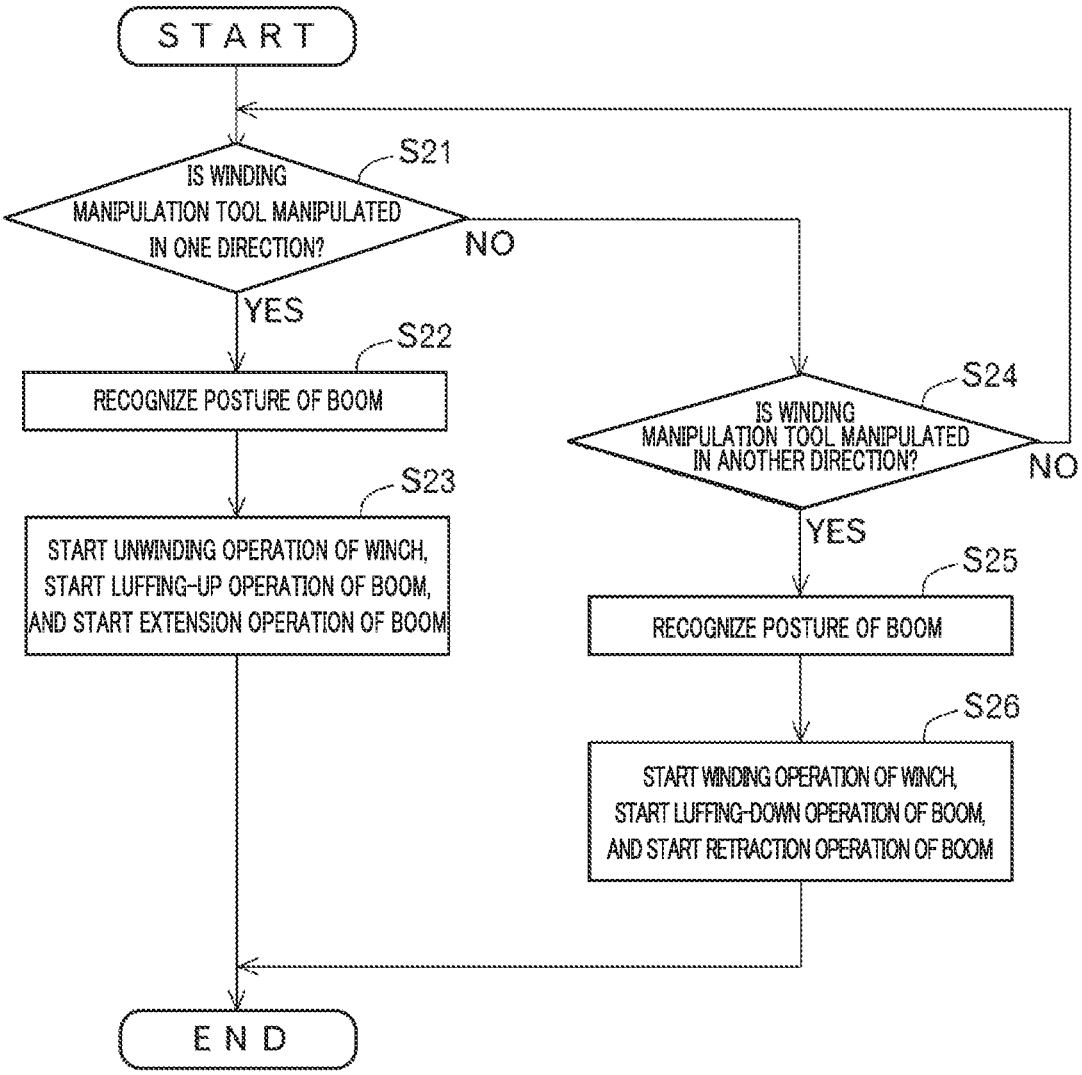
FIG. 8 illustrates a control mode for manipulation of the winding manipulation tool.
Figure 9:
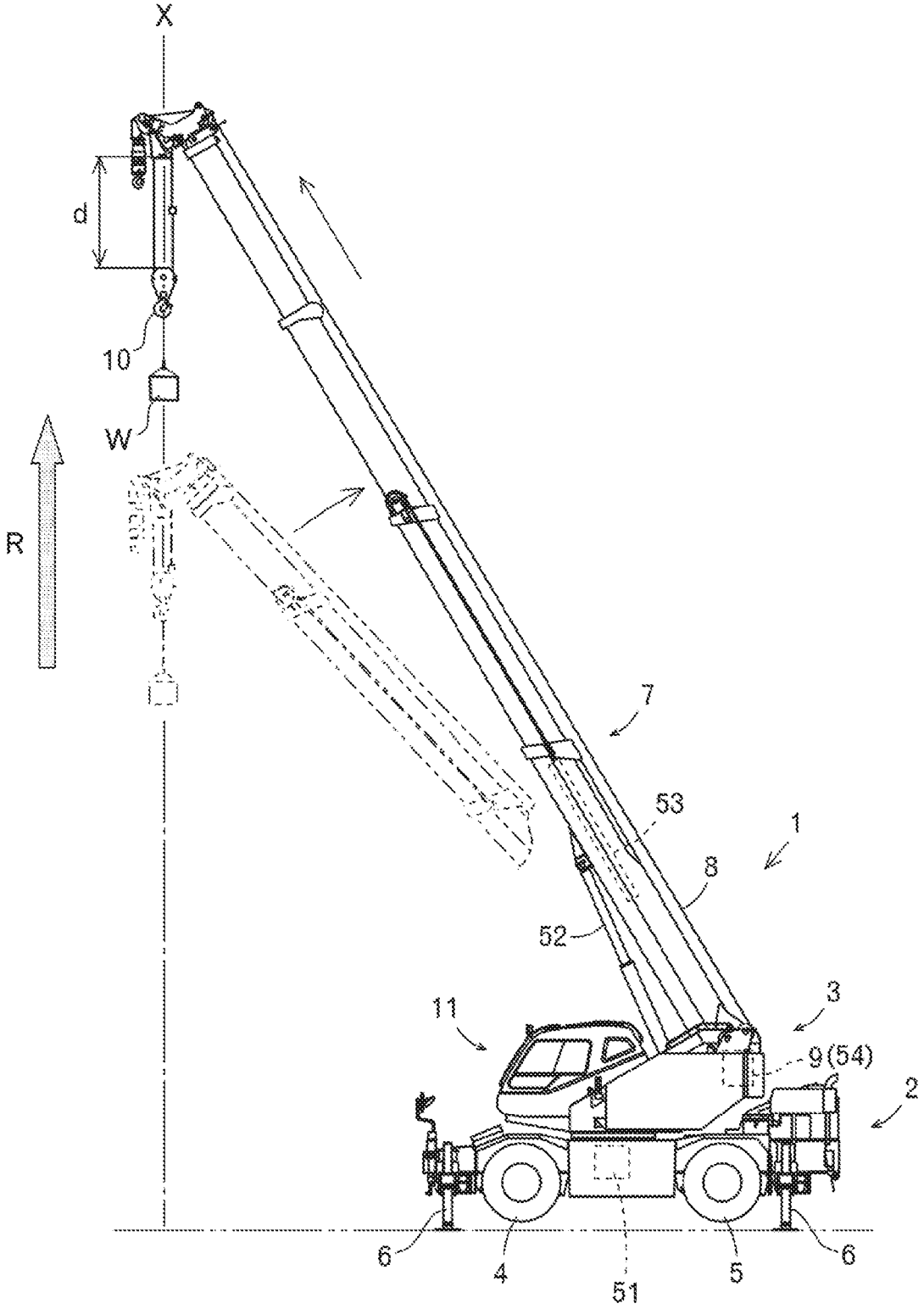
FIG. 9 illustrates a situation in which the load is being hoisted by the luffing-up operation and the extension operation of the boom.
Figure 10:
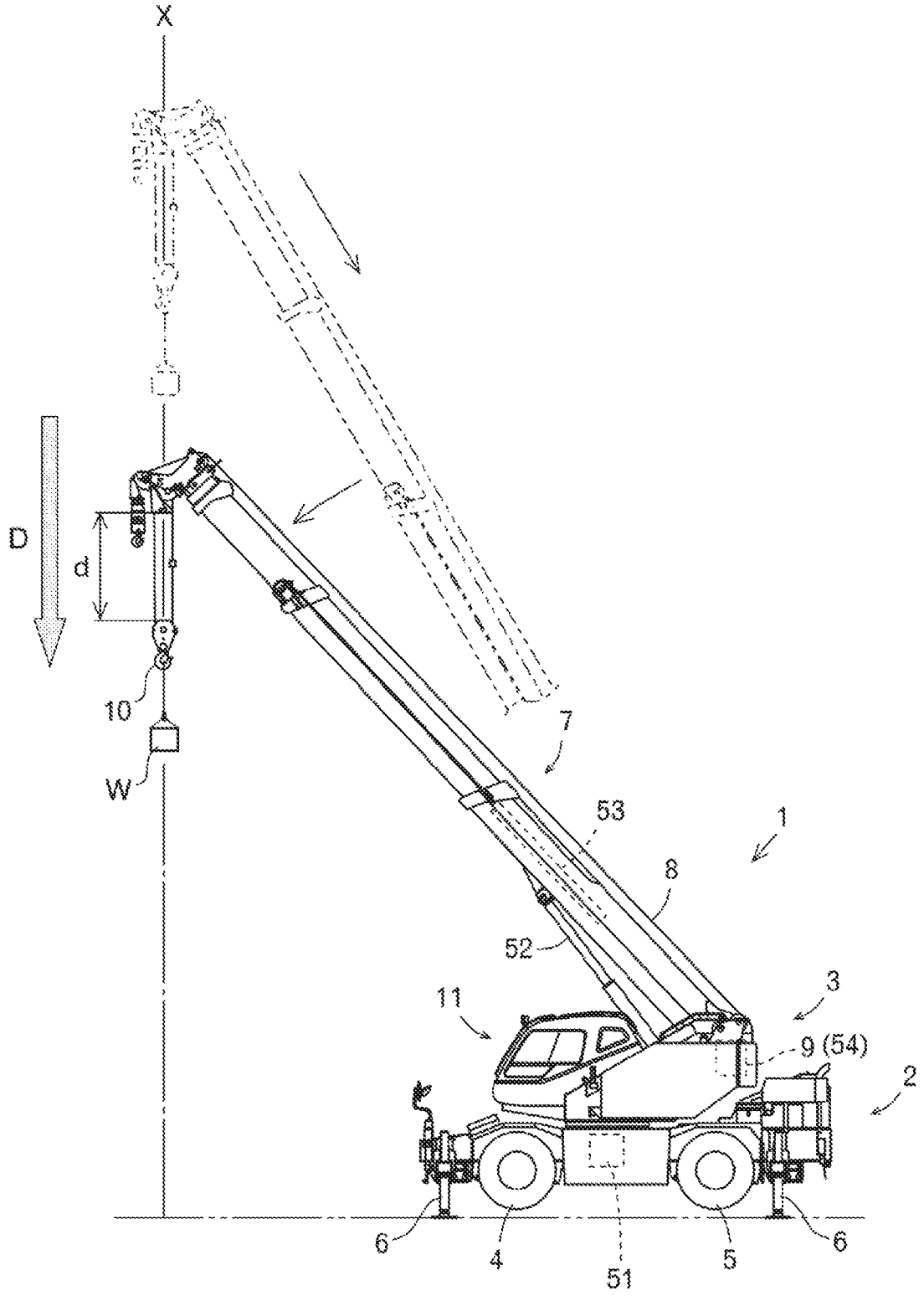
FIG. 10 illustrates a situation in which the load suspended is lowered by luffing-down operation and retraction operation of the boom.

Next, a control mode for manipulation of winding manipulation tool 24 will be described with reference to FIGS. 8 to 10. Here, the description will be given of a case where one of switching buttons 25 is pressed.

At step S21, control apparatus 100 determines whether or not winding manipulation tool 24 is manipulated in one direction (direction in which hook 10 is raised). When it is determined that winding manipulation tool 24 has been manipulated in the one direction, the control proceeds to step S22, and when it is determined that winding manipulation tool 24 has not been manipulated in the one direction, the control proceeds to step S24.

At step S22, control apparatus 100 recognizes the posture of boom 7 (boom angle G and boom length H; see FIG. 1). This is because the control amount for each control target changes depending on the posture of boom 7. This is because the extension amount of boom 7 is small with respect to the angular change caused by the luffing-up operation in a posture in which boom 7 is relatively luffed down and boom angle G is small, but the extension amount of boom 7 is large with respect to the angular change caused by the luffing-up operation in a posture in which boom 7 is relatively luffed up and boom angle G is large, for example. Note that, the unwinding amount of wire rope 8 unwound by winch 9 is associated with the extension amount of boom 7. Thereafter, the control proceeds to step S23.

At step S23, control apparatus 100 starts the unwinding operation of winch 9 and also starts the luffing-up operation and the extension operation of boom 7. Specifically, control apparatus 100 controls winding valve 34 to supply hydraulic oil to winding motor 54 through pipe 54*b*. Then, winding motor 54 rotates in the other direction at an appropriate speed. That is, winch 9 rotates reversely at an appropriate speed.

Control apparatus 100 starts luffing-up operation of boom 7 at the same time. Specifically, control apparatus 100 controls luffing valve 32 to supply hydraulic fluid to luffing cylinder 52 through pipe 52*a*. Then, luffing cylinder 52 extends at an appropriate speed. That is, boom 7 is luffed up at an appropriate speed.

Further, control apparatus 100 starts extension operation of boom 7 at the same time. Specifically, control apparatus 100 controls extension/retraction valve 33 to supply hydraulic fluid to extension/retraction cylinder 53 through pipe 53*a*. Then, extension/retraction cylinder 53 extends at an appropriate speed. That is, boom 7 extends at an appropriate speed. Thus, it is possible to raise hook 10 by the luffing-up operation and the extension operation of boom 7 (see arrow R in FIG. 9) while keeping suspension length d of hook 10. Note that, hook 10 rises along imaginary line X that is parallel to the direction in which gravity acts. This is achieved by adjusting the speed at which boom 7 is luffed up and the speed at which boom 7 extends. In addition, the speed at which boom 7 is luffed up and the speed at which boom 7 extends can be changed by manipulation of winding manipulation tool 24, with the association with each other being maintained. Thus, the raising operation speed of hook 10 is changeable by the manipulation of winding manipulation tool 24.

Meanwhile, at step S24, control apparatus 100 determines whether or not winding manipulation tool 24 is manipulated in the other direction (direction in which hook 10 is lowered). When it is determined that winding manipulation tool 24 has been manipulated in the other direction, the control proceeds to step S25, and when it is determined that winding manipulation tool 24 has not been manipulated also in the other direction, the control waits without proceeding.

At step S25, control apparatus 100 recognizes the posture of boom 7 (boom angle G and boom length H; see FIG. 1). This is because the control amount for each control target changes depending on the posture of boom 7. This is because the retraction amount of boom 7 is great with respect to the angular change caused by the luffing-down operation in a posture in which boom 7 is relatively luffed up and boom angle G is large, but the retraction amount of boom 7 is small with respect to the angular change caused by the luffing-down operation in a posture in which boom 7 is relatively luffed down and boom angle G is small, for example. Note that, the winding amount of wire rope 8 wound by winch 9 is associated with the extension amount of boom 7. Thereafter, the control proceeds to step S26.

At step S26, control apparatus 100 starts the winding operation of winch 9 and also starts the luffing-down operation and the retraction operation of boom 7. Specifically, control apparatus 100 controls winding valve 34 to supply hydraulic oil to winding motor 54 through pipe 54*a*. Then, winding motor 54 rotates in one direction at an appropriate speed. That is, winch 9 rotates forward at an appropriate speed.

Control apparatus 100 starts luffing-down operation of boom 7 at the same time. Specifically, control apparatus 100 controls luffing valve 32 to supply hydraulic fluid to luffing cylinder 52 through pipe 52*b*. Then, luffing cylinder 52 retracts at an appropriate speed. That is, boom 7 is luffed down at an appropriate speed.

Further, control apparatus 100 starts retraction operation of boom 7 at the same time. Specifically, control apparatus 100 controls extension/retraction valve 33 to supply hydraulic fluid to extension/retraction cylinder 53 through pipe 53*b*. Then, extension/retraction cylinder 53 retracts at an appropriate speed. That is, boom 7 retracts at an appropriate speed. Thus, it is possible to lower hook 10 by the luffing-down operation and the retraction operation of boom 7 (see arrow D in FIG. 10), while keeping suspension length d of hook 10. Note that, hook 10 is lowered along imaginary line X that is parallel to the direction in which gravity acts. This is achieved by adjusting the speed at which boom 7 is luffed down and the speed at which boom 7 retracts. In addition, the speed at which boom 7 is luffed down and the speed at which boom 7 retracts can be changed by manipulation of winding manipulation tool 24, with the association with each other being maintained. Thus, the lowering operation speed of hook 10 is changeable by the manipulation of winding manipulation tool 24.

As described above, crane 1 of the present invention includes winding manipulation tool 24 that allows giving an instruction on the operating state of winch 9, and the switch (selector switch 41) that allows instructing that suspension length d of hook 10 be kept. When winding manipulation tool 24 is manipulated in one direction while the switch (41) is in an "ON" state, boom 7 is luffed up and extended to raise hook 10 while wire rope 8 is unwound such that suspension length d of hook 10 is kept, and, when winding manipulation tool 24 is manipulated in the other direction while the switch (41) is in the "ON" state, boom 7 is luffed down and retracted to lower hook 10 while wire rope 8 is wound such that suspension length d of hook 10 is kept. According to such a crane 1, manipulation of luffing up and extending boom 7 while unwinding wire rope 8 at the same time is not required. Further, since no manipulative error can occur in connection with the manipulation of luffing up and extending boom 7, it is possible to prevent hook 10 or load W from colliding with the side surface of a building or the like. Likewise, according to such a crane 1, manipulation of luffing down and retracting boom 7 while winding wire rope 8 at the same time is not required. Further, since no manipulative error can occur in connection with the manipulation of luffing down and retracting boom 7, it is possible to prevent hook 10 or load W from colliding with the side surface of a building or the like. Accordingly, it is possible to achieve improvement in manipulability and safety.

Further, according to crane 1 of the present invention, the raising/lowering operation of hook 10 is performed vertically upward or vertically downward by adjusting the luffing-up operation and extension operation of boom 7 or the luffing-down operation and retraction operation of boom 7. According to such a crane 1, since hook 10 or load W does not move horizontally, it is possible to achieve further improvement in safety.

Further, according to crane 1 of the present invention, the raising/lowering operation speed of hook 10 raised by the luffing-up operation and the extension operation of boom 7 or lowered by the luffing-down operation and the retraction operation of boom 7 is changeable by the manipulation of winding manipulation tool 24. According to such a crane 1, since the raising/lowering operation speed can be easily increased or decreased at the will of an operator, it is possible to achieve further improvement in manipulability and safety.

Figure 11:
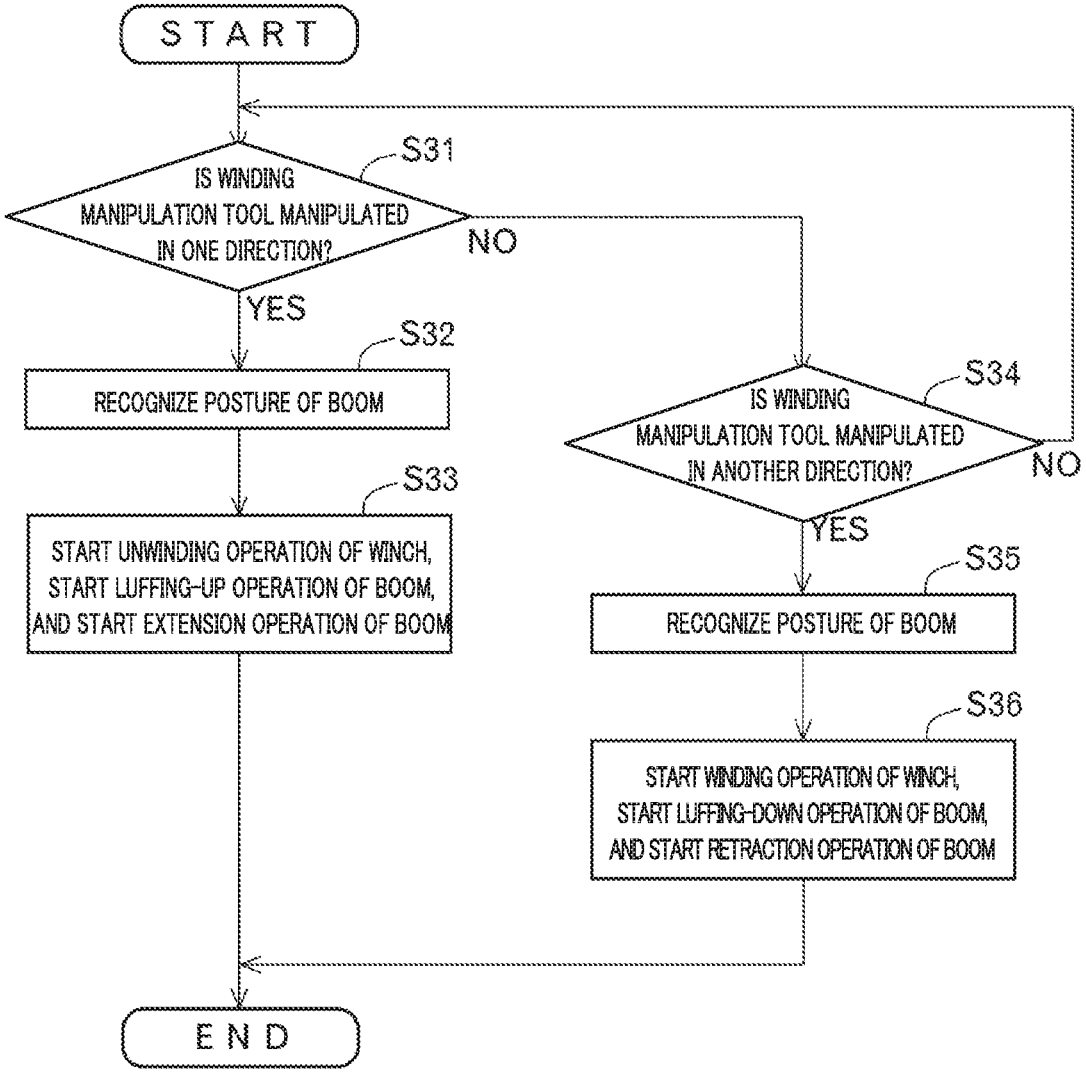
FIG. 11 illustrates a control mode for manipulation of the winding manipulation tool.
Figure 12:
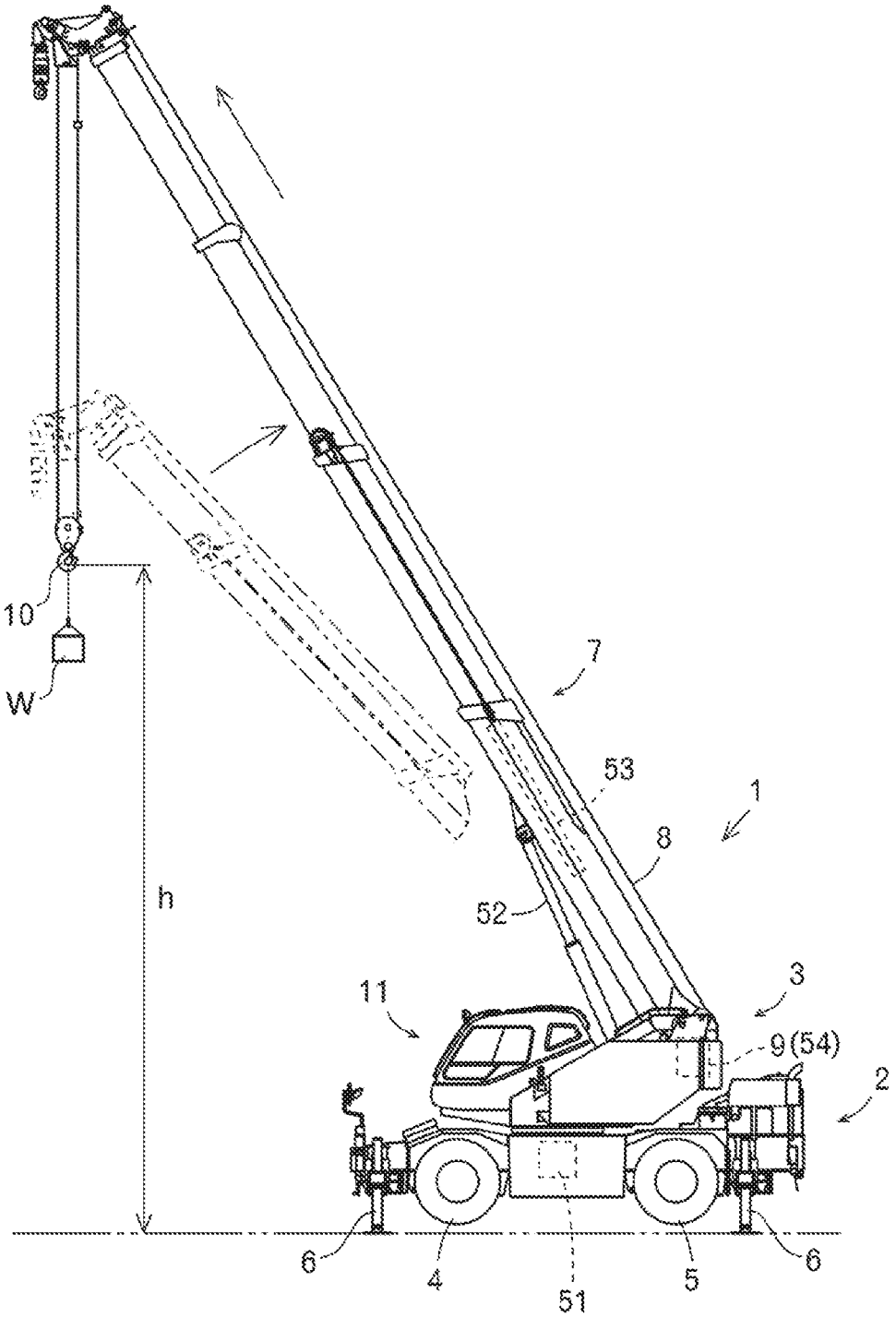
FIG. 12 illustrates a situation in which the posture is changed by the luffing-up operation and the extension operation of the boom.
Figure 13:
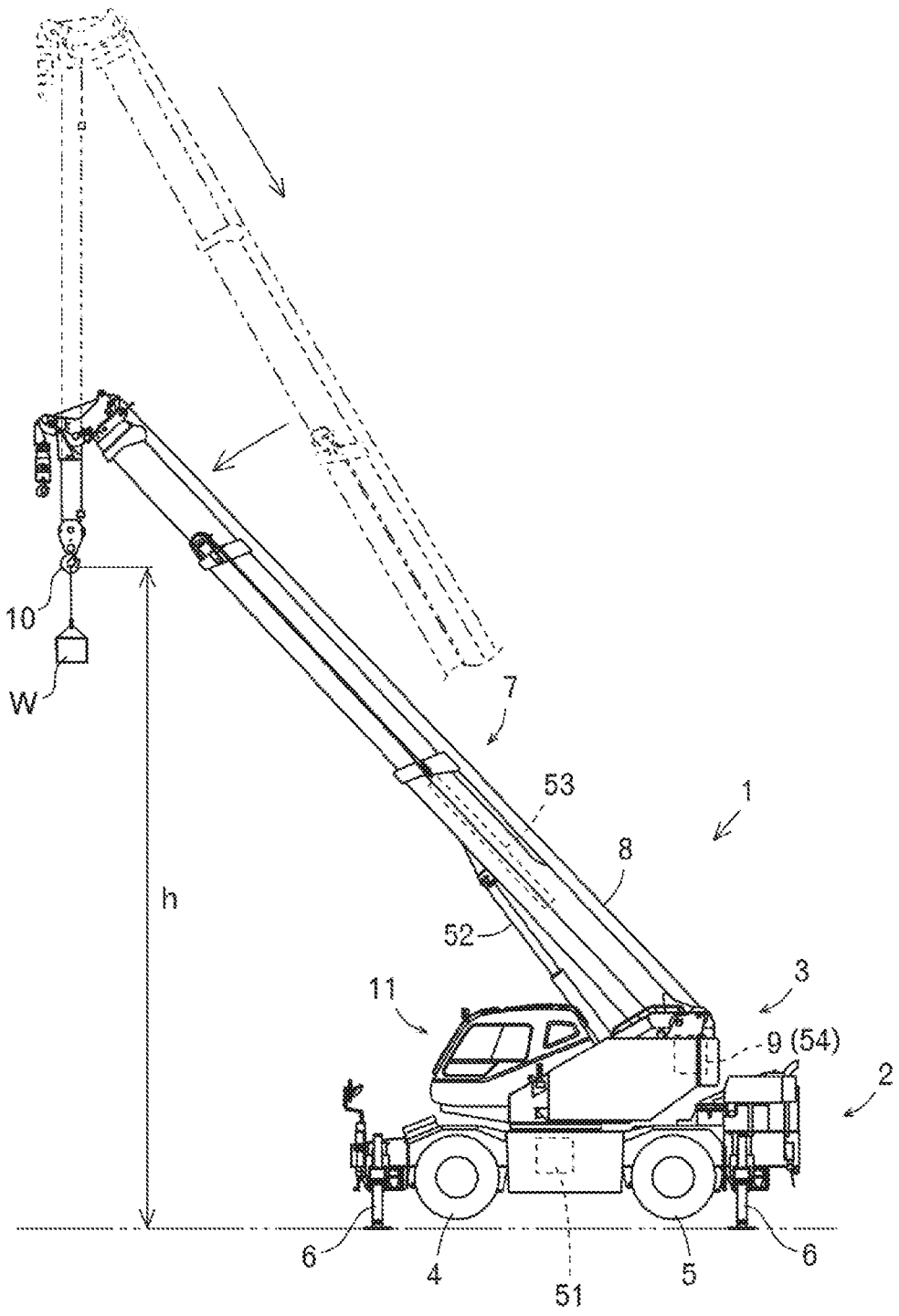
FIG. 13 illustrates a situation in which the posture is changed by the luffing-down operation and the retraction operation of the boom.

Next, a control mode for manipulation of winding manipulation tool 24 will be described with reference to FIGS. 11 to 13. Here, the description will be given of a case where the other one of switching buttons 25 is pressed.

At step S31, control apparatus 100 determines whether or not winding manipulation tool 24 is manipulated in one direction (direction in which hook 10 is raised). When it is determined that winding manipulation tool 24 has been manipulated in the one direction, the control proceeds to step S32, and when it is determined that winding manipulation tool 24 has not been manipulated in the one direction, the control proceeds to step S34.

At step S32, control apparatus 100 recognizes the posture of boom 7 (boom angle G and boom length H; see FIG. 1). This is because the control amount for each control target changes depending on the posture of boom 7. This is because the extension amount of boom 7 is small with respect to the angular change caused by the luffing-up operation in a posture in which boom 7 is relatively luffed down and boom angle G is small, but the extension amount of boom 7 is large with respect to the angular change caused by the luffing-up operation in a posture in which boom 7 is relatively luffed up and boom angle G is large, for example. Note that, the unwinding amount of wire rope 8 unwound by winch 9 is associated with the extension amount of boom 7. Thereafter, the control proceeds to step S33.

At step S33, control apparatus 100 starts the unwinding operation of winch 9 and also starts the luffing-up operation and the extension operation of boom 7. Specifically, control apparatus 100 controls winding valve 34 to supply hydraulic oil to winding motor 54 through pipe 54*b*. Then, winding motor 54 rotates in the other direction at an appropriate speed. That is, winch 9 rotates reversely at an appropriate speed.

Control apparatus 100 starts luffing-up operation of boom 7 at the same time. Specifically, control apparatus 100 controls luffing valve 32 to supply hydraulic fluid to luffing cylinder 52 through pipe 52*a*. Then, luffing cylinder 52 extends at an appropriate speed. That is, boom 7 is luffed up at an appropriate speed.

Further, control apparatus 100 starts extension operation of boom 7 at the same time. Specifically, control apparatus 100 controls extension/retraction valve 33 to supply hydraulic fluid to extension/retraction cylinder 53 through pipe 53*a*. Then, extension/retraction cylinder 53 extends at an appropriate speed. That is, boom 7 extends at an appropriate speed. Thus, the posture of boom 7 can be changed by the luffing-up operation and the extension operation of boom 7 while keeping lifting height h of hook 10 (see FIG. 12). Note that, the position of hook 10 is maintained such that the hook does not move in the upper-lower direction or in the horizontal direction. This is achieved by adjusting the speed at which wire rope 8 is unwound, the speed at which boom 7 is luffed up, and the speed at which boom 7 extends. In addition, the speed at which wire rope 8 is unwound, the speed at which boom 7 is luffed up, and the speed at which boom 7 extends can be changed by manipulation of winding manipulation tool 24, with the association with one another being maintained. Thus, the postural change speed of boom 7 can be changed by the manipulation of winding manipulation tool 24.

Meanwhile, at step S34, control apparatus 100 determines whether or not winding manipulation tool 24 is manipulated in the other direction (direction in which hook 10 is lowered). When it is determined that winding manipulation tool 24 has been manipulated in the other direction, the control proceeds to step S35, and when it is determined that winding manipulation tool 24 has not been manipulated also in the other direction, the control waits without proceeding.

At step S35, control apparatus 100 recognizes the posture of boom 7 (boom angle G and boom length H; see FIG. 1). This is because the control amount for each control target changes depending on the posture of boom 7. This is because the retraction amount of boom 7 is great with respect to the angular change caused by the luffing-down operation in a posture in which boom 7 is relatively luffed up and boom angle G is large, but the retraction amount of boom 7 is small with respect to the angular change caused by the luffing-down operation in a posture in which boom 7 is relatively luffed down and boom angle G is small, for example. Note that, the winding amount of wire rope 8 wound by winch 9 is associated with the extension amount of boom 7. Thereafter, the control proceeds to step S36.

At step S36, control apparatus 100 starts the winding operation of winch 9 and also starts the luffing-down operation and the retraction operation of boom 7. Specifically, control apparatus 100 controls winding valve 34 to supply hydraulic oil to winding motor 54 through pipe 54*a*. Then, winding motor 54 rotates in one direction at an appropriate speed. That is, winch 9 rotates forward at an appropriate speed.

Control apparatus 100 starts luffing-down operation of boom 7 at the same time. Specifically, control apparatus 100 controls luffing valve 32 to supply hydraulic fluid to luffing cylinder 52 through pipe 52*b*. Then, luffing cylinder 52 retracts at an appropriate speed. That is, boom 7 is luffed down at an appropriate speed.

Further, control apparatus 100 starts retraction operation of boom 7 at the same time. Specifically, control apparatus 100 controls extension/retraction valve 33 to supply hydraulic fluid to extension/retraction cylinder 53 through pipe 53*b*. Then, extension/retraction cylinder 53 retracts at an appropriate speed. That is, boom 7 retracts at an appropriate speed. Thus, the posture of boom 7 can be changed by the luffing-down operation and the retraction operation of boom 7 while keeping lifting height h of hook 10 (see FIG. 13). Note that, the position of hook 10 is maintained such that the hook does not move in the upper-lower direction or in the horizontal direction. This is achieved by adjusting the speed at which wire rope 8 is wound, the speed at which boom 7 is luffed down, and the speed at which boom 7 retracts. In addition, the speed at which wire rope 8 is wound, the speed at which boom 7 is luffed down, and the speed at which boom 7 retracts can be changed by manipulation of winding manipulation tool 24, with the association with one another being maintained. Thus, the postural change speed of boom 7 can be changed by the manipulation of winding manipulation tool 24.

As described above, crane 1 of the present invention includes winding manipulation tool 24 that allows giving an instruction on the operating state of winch 9, and the switch (selector switch 41) that allows instructing that lifting height h of hook 10 be kept. When winding manipulation tool 24 is manipulated in the one direction when the switch (41) is in the "ON" state, boom 7 is luffed up and extended to change the posture of boom 7 while wire rope 8 is unwound such that lifting height h of hook 10 is kept, and, when winding manipulation tool 24 is manipulated in the other direction when the switch (41) is in the "ON" state, boom 7 is luffed down and retracted to change the posture of boom 7 while wire rope 8 is wound such that lifting height h of hook 10 is kept. According to such a crane 1, manipulation of luffing up and extending boom 7 while unwinding wire rope 8 at the same time is not required. Further, since no manipulative error can occur in connection with the manipulation of luffing up and extending boom 7, it is possible to prevent hook 10 or load W from colliding with the side surface of a building or the like. Likewise, according to such a crane 1, manipulation of luffing down and retracting boom 7 while winding wire rope 8 at the same time is not required. Further, since no manipulative error can occur in connection with the manipulation of luffing down and retracting boom 7, it is possible to prevent hook 10 or load W from colliding with the side surface of a building or the like. Accordingly, it is possible to achieve improvement in manipulability and safety.

Further, according to crane 1 of the present invention, the position of hook 10 is maintained by adjusting the luffing-up operation and the extension operation of boom 7 or the luffing-down operation and the retraction operation of boom 7. According to such a crane 1, since hook 10 or load W does not move in the upper-lower direction or in the horizontal direction, it is possible to achieve further improvement in safety.

Further, according to crane 1 of the present invention, the postural change speed of boom 7 in the luffing-up operation and extension operation of boom 7 or in the luffing-down operation and retraction operation of boom 7 is changeable by manipulation of winding manipulation tool 24. According to such a crane 1, since the postural change speed can be easily increased or decreased at the will of an operator, it is possible to achieve further improvement in manipulability and safety.

Figure 14:
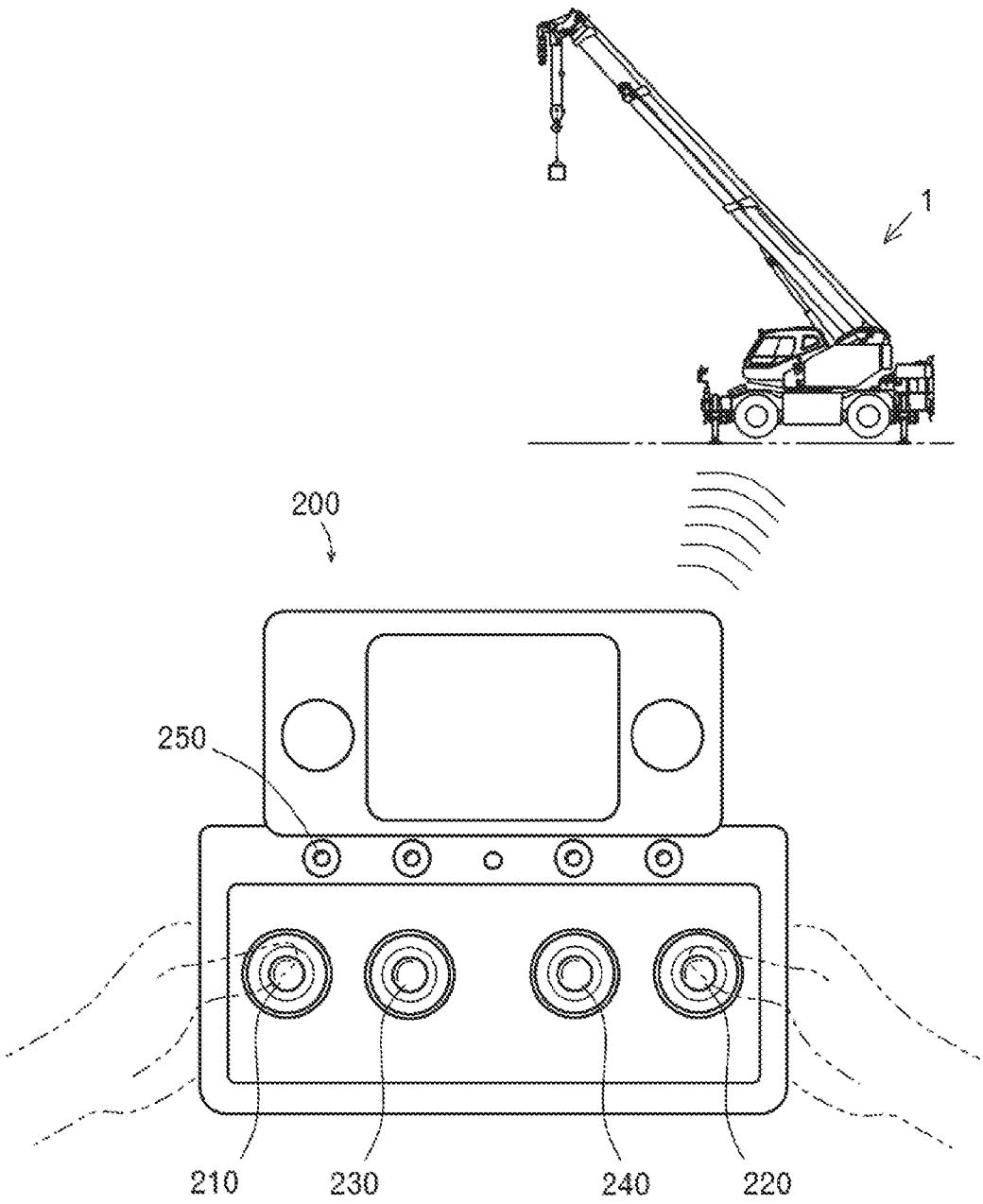
FIG. 14 illustrates a remote manipulation terminal.

Next, remote manipulation terminal 200 will be described with reference to FIG. 14. However, remote manipulation terminal 200 is an example of a remote manipulation terminal and the remote manipulation terminal is not limited this example.

Remote manipulation terminal 200 is provided with swivel manipulation tool 210, luffing manipulation tool 220, extension/retraction manipulation tool 230, winding manipulation tool 240, and/or the like required for carriage manipulation. Remote manipulation terminal 200 is also provided with switching button 250.

When the operator manipulates swivel manipulation tool 210, crane 1 operates in the same manner as in the above-described case where swivel manipulation tool 21 is manipulated. Further, when the operator manipulates luffing manipulation tool 220, the crane operates in the same manner as in the above-described case where luffing manipulation tool 22 is manipulated. Further, when the operator manipulates extension/retraction manipulation tool 230, the crane operates in the same manner as in the above-described case where extension/retraction manipulation tool 23 is manipulated. When the operator manipulates winding manipulation tool 240, the crane operates in the same manner as in the above-described case where winding manipulation tool 24 is manipulated. In addition, when the operator presses switching button 250, crane 1 operates in the same manner as in the above-described case where switching button 25 is manipulated. As is understood, the technical idea disclosed in the present specification can be realized also with remote manipulation terminal 200.

Lastly, crane 1 of the present invention may be configured to include a joystick instead of manipulation tools 21 to 23, and a switch or the like instead of winding manipulation tool 24. Additionally or alternatively, remote manipulation terminal 200 may be configured to include a joystick instead of manipulation tools 210, 220, and 230, and a switch or the like instead of winding manipulation tool 240. According to such a crane, the operator can manipulate load W as a manipulation target rather than manipulate boom 7 or winch 9 as manipulation targets. In this case, an instruction on the moving direction of load W is directly given, and boom 7 and winch 9 are operated to carry out the instruction.

In addition, boom 7 and winch 9 are targets to be controlled in the invention according to the present application. Here, in a case where boom 7 is, at the leading end portion, provided with a jib and this jib is capable of being luffed up, the jib instead of boom 7 may be luffed up in first to third inventions. In addition, the jib instead of boom 7 may also be luffed up or down in fourth to sixth inventions. Further, the jib instead of boom 7 may also be luffed up or down in seventh to ninth inventions. That is, the jib is included in boom 7 as a component of boom 7.

INDUSTRIAL APPLICABILITY

The present invention is applicable to cranes. Specifically, the present invention is applicable to a crane which achieves improvement in manipulability and safety.

REFERENCE SIGNS LIST

1 Crane
2 Traveling body
3 Swiveling body
7 Boom
8 Wire rope
9 Winch
10 Hook
12 Weight
21 Swivel manipulation tool
22 Luffing manipulation tool
23 Extension/retraction manipulation tool
24 Winding manipulation tool
25 Switching button
31 Swivel valve
32 Luffing valve
33 Extension/retraction valve
34 Winding valve
41 Selector switch (switch)
42 Overwinding sensor (sensor)
51 Swivel motor
52 Luffing cylinder
53 Extension/retraction cylinder
54 Winding motor
100 Control apparatus
d Suspension length
h Lifting height
W Load

The invention claimed is:

1. A crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane comprising:

a winding manipulation tool that allows giving an instruction on an operating state of the winch, wherein, the hook is raised by winding the wire rope based on manipulation of the winding manipulation tool, when the hook is raised to a height at which a suspension length is a predetermined suspension length, the boom is subsequently luffed up and extended to continue raising operation of the hook while the wire rope is unwound such that the suspension length is kept.

2. The crane according to claim 1, wherein the raising operation of the hook is performed vertically upward by adjusting luffing-up operation and extension operation of the boom.

3. The crane according to claim 2, further comprising:

a control apparatus that controls luffing-up and luffing-down operation and extension and retraction operation of the boom and unwinding and winding operation of the winch, wherein, the control apparatus controls the winding operation of the winch to raise the hook based on manipulation of the winding manipulation tool, and in a case where the hook is raised to the height at which the suspension length is the predetermined suspension length, the control apparatus subsequently controls the luffing-up operation and the extension operation of the boom and the unwinding operation of the winch such that the suspension length is kept.

4. The crane according to claim 1, wherein a raising operation speed of the hook raised by luffing-up operation and extension operation of the boom is changeable by manipulation of the winding manipulation tool.

5. The crane according to claim 4, further comprising:

a control apparatus that controls luffing-up and luffing-down operation and extension and retraction operation of the boom and unwinding and winding operation of the winch, wherein, the control apparatus controls the winding operation of the winch to raise the hook based on manipulation of the winding manipulation tool, and in a case where the hook is raised to the height at which the suspension length is the predetermined suspension length, the control apparatus subsequently controls the luffing-up operation and the extension operation of the boom and the unwinding operation of the winch such that the suspension length is kept.

6. The crane according to claim 1, further comprising:

a control apparatus that controls luffing-up and luffing-down operation and extension and retraction operation of the boom and unwinding and winding operation of the winch, wherein, the control apparatus controls the winding operation of the winch to raise the hook based on manipulation of the winding manipulation tool, and in a case where the hook is raised to the height at which the suspension length is the predetermined suspension length, the control apparatus subsequently controls the luffing-up operation and the extension operation of the boom and the unwinding operation of the winch such that the suspension length is kept.

7. A crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane comprising:

a winding manipulation tool that allows giving an instruction on an operating state of the winch; and a switch that allows instructing that a suspension length of the hook be kept, wherein, when the winding manipulation tool is manipulated in one direction while the switch is in an "ON" state, the boom is luffed up and extended to raise the hook while the wire rope is unwound such that the suspension length of the hook is kept, and, when the winding manipulation tool is manipulated in an other direction while the switch is in the "ON" state, the boom is luffed down and retracted to lower the hook while the wire rope is wound such that the suspension length of the hook is kept.

8. The crane according to claim 7, wherein raising/lowering operation of the hook is performed vertically upward or vertically downward by adjusting luffing-up operation and extension operation of the boom or luffing-down operation and retraction operation of the boom.

9. The crane according to claim 8, further comprising:

a control apparatus that controls luffing-up and luffing-down operation and extension and retraction operation of the boom and unwinding and winding operation of the winch, wherein in a case where the winding manipulation tool is manipulated in the one direction while the switch is in the "ON" state, the control apparatus controls the luffing-up operation and the extension operation of the boom and the unwinding operation of the winch such that the suspension length of the hook is kept, and, in a case where the winding manipulation tool is manipulated in the other direction while the switch is in the "ON" state, the control apparatus controls the luffing-down operation and the retraction operation of the boom and the winding operation of the winch such that the suspension length of the hook is kept.

10. The crane according to claim 7, wherein a raising/lowering operation speed of the hook raised by luffing-up operation and extension operation of the boom or lowered by luffing-down operation and retraction operation of the boom is changeable by manipulation of the winding manipulation tool.

11. The crane according to claim 10, further comprising:

a control apparatus that controls luffing-up and luffing-down operation and extension and retraction operation of the boom and unwinding and winding operation of the winch, wherein in a case where the winding manipulation tool is manipulated in the one direction while the switch is in the "ON" state, the control apparatus controls the luffing-up operation and the extension operation of the boom and the unwinding operation of the winch such that the suspension length of the hook is kept, and, in a case where the winding manipulation tool is manipulated in the other direction while the switch is in the "ON" state, the control apparatus controls the luffing-down operation and the retraction operation of the boom and the winding operation of the winch such that the suspension length of the hook is kept.

12. The crane according to claim 7, further comprising:

a control apparatus that controls luffing-up and luffing-down operation and extension and retraction operation of the boom and unwinding and winding operation of the winch, wherein in a case where the winding manipulation tool is manipulated in the one direction while the switch is in the "ON" state, the control apparatus controls the luffing-up operation and the extension operation of the boom and the unwinding operation of the winch such that the suspension length of the hook is kept, and, in a case where the winding manipulation tool is manipulated in the other direction while the switch is in the "ON" state, the control apparatus controls the luffing-down operation and the retraction operation of the boom and the winding operation of the winch such that the suspension length of the hook is kept.

13. A crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane comprising:

a winding manipulation tool that allows giving an instruction on an operating state of the winch; and a switch that allows instructing that a lifting height of the hook be kept, wherein, when the winding manipulation tool is manipulated in one direction while the switch is in an "ON" state, the boom is luffed up and extended to change a posture of the boom while the wire rope is unwound such that the lifting height of the hook is kept, and, when the winding manipulation tool is manipulated in an other direction while the switch is in the "ON" state, the boom is luffed down and retracted to change the posture of the boom while the wire rope is wound such that the lifting height of the hook is kept.

14. The crane according to claim 13, wherein a position of the hook is maintained by adjusting luffing-up operation and extension operation of the boom or luffing-down operation and retraction operation of the boom.

15. The crane according to claim 14, further comprising:

a control apparatus that controls luffing-up and luffing-down operation and extension and retraction operation of the boom and unwinding and winding operation of the winch, wherein in a case where the winding manipulation tool is manipulated in the one direction while the switch is in the "ON" state, the control apparatus controls the luffing-up operation and the extension operation of the boom and the unwinding operation of the winch such that the lifting height of the hook is kept, and, in a case where the winding manipulation tool is manipulated in the other direction while the switch is in the "ON" state, the control apparatus controls the luffing-down operation and the retraction operation of the boom and the winding operation of the winch such that the lifting height of the hook is kept.

16. The crane according to claim 13, wherein a postural change speed of the boom in luffing-up operation and extension operation of the boom or in luffing-down operation and retraction operation of the boom is changeable by manipulation of the winding manipulation tool.

17. The crane according to claim 16, further comprising:

a control apparatus that controls luffing-up and luffing-down operation and extension and retraction operation of the boom and unwinding and winding operation of the winch, wherein in a case where the winding manipulation tool is manipulated in the one direction while the switch is in the "ON" state, the control apparatus controls the luffing-up operation and the extension operation of the boom and the unwinding operation of the winch such that the lifting height of the hook is kept, and, in a case where the winding manipulation tool is manipulated in the other direction while the switch is in the "ON" state, the control apparatus controls the luffing-down operation and the retraction operation of the boom and the winding operation of the winch such that the lifting height of the hook is kept.

18. The crane according to claim 13, further comprising:

a control apparatus that controls luffing-up and luffing-down operation and extension and retraction operation of the boom and unwinding and winding operation of the winch, wherein in a case where the winding manipulation tool is manipulated in the one direction while the switch is in the "ON" state, the control apparatus controls the luffing-up operation and the extension operation of the boom and the unwinding operation of the winch such that the lifting height of the hook is kept, and, in a case where the winding manipulation tool is manipulated in the other direction while the switch is in the "ON" state, the control apparatus controls the luffing-down operation and the retraction operation of the boom and the winding operation of the winch such that the lifting height of the hook is kept.

* * * * *